United States Patent [19]

Brockhaus et al.

[11] Patent Number: 4,528,926

[45] Date of Patent: Jul. 16, 1985

[54] MAST FOOT MOUNTING SYSTEM FOR A SAILBOARD

[75] Inventors: Peter Brockhaus, Munich; Roland Jungkind, Garmisch-Partenkirchen, both of Fed. Rep. of Germany

[73] Assignee: Peter Brockhaus GmbH & Co. Handels KG, Eurasburg, Fed. Rep. of Germany

[21] Appl. No.: 521,848

[22] Filed: Aug. 10, 1983

[30] Foreign Application Priority Data

Aug. 11, 1982 [DE] Fed. Rep. of Germany ..... 3229910

[51] Int. Cl.[3] ..... B63B 15/00

[52] U.S. Cl. ..... 114/90

[58] Field of Search ..... 114/90, 91, 39, 39.2

[56] References Cited

U.S. PATENT DOCUMENTS 3,827,386 8/1974 Faden ..... 114/91

FOREIGN PATENT DOCUMENTS 0054241 6/1982 European Pat. Off. .
2747057 4/1978 Fed. Rep. of Germany .
2700446 7/1978 Fed. Rep. of Germany .
7829058 2/1979 Fed. Rep. of Germany .
2843551 4/1980 Fed. Rep. of Germany .
2945624 5/1981 Fed. Rep. of Germany .
WO81/01125 4/1981 PCT Int'l Appl. .

*Primary Examiner*—Jesûs D. Sotelo
*Attorney, Agent, or Firm*—Bacon & Thomas

[57] ABSTRACT

The mast foot mounting system for a sailboard in accordance with the invention comprises a slide track and a sliding shoe supported for displacement in the slide track and carrying the mast foot and adapted to be locked firmly in a plurality of positions along the slide track. An actuator always remaining in a fixed position is disposed at the sternward end of the slide track for release of the lock. The narrow sliding shoe is provided in front of the mast foot pin with a safety fastener which permits adjustment of the overload at which the mast foot pin is set free by the safety fastener.

13 Claims, 5 Drawing Figures

MAST FOOT MOUNTING SYSTEM FOR A SAILBOARD

The invention relates to a mast foot mounting system for a sailboard.

Often it is convenient with sailboards or surfboards to displace the point of attack of the sail on the board toward the front or rear in correspondence with the respective driving conditions. To this end a slide rail or slide track is embedded or sunk into the deck of the sailboard so as extend in the longitudinal axis of the board. A sliding shoe holding the pin at the butt end or foot of the mast is guided for displacement along said rail or track.

When sailing off the wind, the mast is moved toward the stern together with the sliding shoe because, when on this course, the board rides on a smaller surface area and is much easier to control with the pressure center displaced to the rear toward the center of the board. In this case the maneuverability of the sailboard is improved because the same effect is achieved as if a shorter board were used. The centerboard in this instance is totally raised.

On the other hand, in cruising or steering a mid-course, the mast is brought to a forward position because then the sailboard is easier to handle and a much better luff speed can be gained. Corresponding adjustment of the mast further permits us the use of sails having a lower cut aft leech which then will not drag in the water but, in general, provide greater speeds than sails having a less low cut.

Intermediate positions of adjustment permit fine adaptation to the respective conditions of wind and course.

In the case of known structures the sliding shoe comprises an arresting or locking means provided with a release button to be operated by the foot. If the surfer wishes to change the mast position while surfing, he must use his foot to push the release button close to the foot of the mast and then displace the mast toward the bow or stern by means of the wishbone boom. However, he must take care to take his foot from the release button because otherwise it would follow the shifting movement and that would endanger the surfer's balance.

This known means not only is inconvenient but may even become dangerous, particularly if a long slide rail or track is chosen to make the surfboard adaptable to extreme driving conditions by the corresponding wide range of adjustability, because with one foot the surfer must give up his normal standing position so as to be able to actuate the release button. Yet at this very point in time safe standing is of utmost importance since the wind pressure influences the shifting of the mast so that careful control of the mast by way of the wishbone boom is necessary.

It is, therefore, an object of the invention to develop the known mast foot mounting system such that it will permit the safe displacement of the mast without any effort, while being of simple structural design.

There is yet another problem related to the mast foot mounting: when the mast falls over, the surfer may get caught with part of his body between the surfboard and the mast. Therefore, it is desirable that the mast should separate easily with its pin from the mast foot mounting system in order to avoid injuries. On the other hand, however, the mast foot mounting system must warrant that the mast does not become loose under wind pressure and leave the holder or mounting system during normal driving.

Before taking to a surf ride, in general, the maximum wind pressure to be expected is known. Thus DE-AS No. 27 47 057 affords the possibility of exchanging a spring member which guarantees the fit of the mast foot pin in a mast foot mounting system for a stronger or weaker one so that the loading required to separate the connection between mast and surfboard body is selectable according to individual need.

Yet the replacement of different springs is a very cumbersome affair. Besides, the known mast foot mounting system is relatively bulky so that it cannot be mounted for instance on the sliding shoe of the adjustable mast foot mounting system mentioned above. Instead, the cited publication proposes two separate receptacles, one behind the other, so that a suitable mast position in accordance with the intended course may be chosen prior to take-off. Of course, with this known surfboard the selected position cannot be changed during sailing.

Starting from this state of the art, it is another object of the invention to provide a mast foot mounting system with which the force required to separate the mast from the sailboard body can be adjusted easily and individually by simple means. The mast foot is to be held by a sliding shoe which runs along a slide rail or track mounted flush in the deck of the sailboard.

Furthermore, a means is to be provided which readily permits the separating force adjusted to be read.

The first object mentioned above is met by the features of claim 1. Preferably a movable locking member is disposed inside the slide track and parallel to the same and this locking member is adapted to engage in various positions in a complementary configuration provided at the sliding shoe so that the latter is retained in fixed position. The engagement may be cancelled by moving the locking member. At the sternward end of the slide track a control means is provided for movement of the locking member and it comprises a foot operable release button and a coupling by which the release button is connected to the locking member for movement thereof.

Thus the release button is located a short distance in front of the centerboard receptacle of the sailboard near the location where the surfer normally puts his foot. The surfer simply exerting pressure with his toe thus may release the sliding shoe and then displace the mast in the desired direction by handling the wishbone boom. As long as pressure is retained on the release button, the mast may be pushed past locking positions without becoming caught. When there is no more pressure on the release button, the mast will move to the next locking position in which it will be arrested.

The locking member itself may comprise movable catches which are drawn out of engagement with a rigid counter assembly in the sliding shoe by longitudinal movement. In a modification of the invention it is of particular advantage that the locking member is designed to be a rod in which notches are formed at one side at the locking positions. This makes it possible to provide the sliding shoe with a rigid lug for engagement with the notches, and to deflect the rod laterally for disengagement. Preferably, however, the sliding shoe comprises a pivotably supported pawl adapted to enter into locking engagement in any desired detent formation. At the same time the coupling is designed as rotary drive means for the locking member rod to rotate the rod by such an angle that the detent formations will be turned out of the range of engagement of the pawl, or the pawl will be pushed out of engagement by a formation provided at the locking member rod.

The rotary support of the rod serving as locking member is easy to be realized and the rotary drive of the rod may be obtained in simple manner by actuating the release button. In accordance with a modification of the invention the locking member rod is arranged adjacent an inside wall of the slide track and the detent or locking formations are remote from this inside wall. This permits the rod to be made relatively thin. The rod cannot deflect to such an extent that the locking engagement would be cancelled unintentionally because the rod first would abut against the inside wall of the slide track.

Preferably a longitudinal groove is formed in the side face of the sliding shoe facing the inside wall so as to receive and support the locking member rod. This precludes rhythmic vibrations, such as wave impacts from causing the long cantilever-type rod to oscillate, thereby becoming free from the catch because the rod is supported in the sliding shoe in the direct vicinity of the pawl which is carried by the sliding shoe.

The coupling may be obtained by providing the end of the locking member rod with a pinion and the release button with a rack. It would also be possible to fix a disc against rotation on the end of the rod and to secure the release button directly at the periphery of the disc or pivot it by a guide rod.

In accordance with another modification of the invention, however, a particularly simple and reliable solution is obtained by having the end of the locking member rod bent at an angle to form a drive crank, the free end of which engages in a recess formed at the underside of the release button which in turn is guided in a vertical guide means and urged in upward direction against the force of a spring. Thus the coupling requires not one single separate member but instead is realized simply by corresponding design of the members needed for its functioning.

In accordance with another modification of the invention the locking means is designed as a block slid into the sternward end of the slide track to form a terminal block. This block in particular is made of plastics, preferably being a die cast member and includes a vertical guide means for the release button and a lateral groove into which the end of the locking member rod is inserted. During assembly a compression spring is set on the bottom of the vertical guide means, the release button is placed on top of the same with its recess and pressed down, and then the locking member rod is inserted laterally, its crank-like end engaging in the recess. Subsequently the terminal block is pushed into the end of the slide track, whereby all members are retained in their respective cooperative functional positions without the need for a separate element to establish that coordination. Suitable choice of the plastic material will warrant that all movable members are supported with little friction, any corrosion such as by sea water being excluded provided the metal members used are made of suitable material. Even after a longer period of use, therefore, the release button still will be operable easily, a fact which greatly improves the manipulating and operational safety of the sailboard furnished with the mast retention system of the invention.

Further improvement and simplification of the manipulation are obtained in accordance with another modification of the invention with which a spring is disposed between the slide track and the sliding shoe to bias the sliding shoe toward the stern. This spring balances the wind pressure tending to move mast and sail toward the bow, and it guarantees that the mast can be moved easily at any time in any direction by way of the ckickenbone boom.

In principle, it would be possible to mount a helical compression spring between the bow-ward end of the slide track and the sliding shoe. However, as there is the risk that such a spring will corrode, it is proposed that preferably a strand of rubber or the like be used which is to be attached between the one end of the slide track and the sliding shoe. Since such a strand-type spring must have a certain minimum length and, on the other hand, the slide track cannot be made any longer toward the stern because its extension is limited by the centerboard receptacle, it would be possible, in principle, to stretch the strand-type spring at the upper side of the sailboard between any place of the centerboard receptacle and the sliding shoe.

For reasons of safety, however, it is preferred that the strand-type spring be mounted so as to be covered up. This is obtained by fixing it at the bow-ward end of the slide track, preferably to a terminal block inserted into this end, passing it between a longitudinal groove in the sliding shoe and the adjacent inside wall of the slide track and then around a guide pulley provided at the sternward end terminal block, and finally securing it at the sternward end of the sliding shoe. In this manner the strand-type spring is completely covered up, has the necessary length for proper functioning, and does not impair the effective utilization of the entire slide track for sliding motions of the sliding shoe. Besides, the strand-type spring firmly holds together the two terminal blocks of the slide track so that any fixing members may be dispensed with to retain these terminal blocks.

With reference to the longitudinal axis the groove serving to take up the rubber strand is located approximately diametrically opposite the groove in which the locking member rod is received. If clearance should occur, it is prevented in this manner that the strand-type spring displaces the sliding shoe in such lateral direction that the engagement between the locking pawl and the notches in the rod is endangered.

As already mentioned initially, it is desirable to have an adjustable safety fastening means which serves to secure the mast foot pin and is releasable upon overload. In accordance with the invention this means is formed in the sliding shoe itself. Contrary to the known surfboard disclosed in DE-AS No. 27 47 057 which had two fixed safety ing means for the mast foot pin, it is possible, according to the invention, to relocate the mast mounted by a safety fastening means in axial position with respect to the sailboard even during a drive.

To this end, the sliding shoe comprises a vertical bore serving to receive the pin of the mast foot formed at its tip with a ring collar, a stop for the ring collar being provided in the bore as well as a catch which is pressed into the bore and yields when a release force is overcome, the catch engaging behind the ring collar which is seated on the stop. The mast foot pin and, consequently, the entire mast is fixed in longitudinal direction since the ring collar of the mast foot pin is caught between the stop and the catch. However, the catch yields when an adjustable release force is overcome so that it will unblock the ring collar and thus the mast foot pin upon overload.

In contrast to the annular spring of DE-AS No. 27 47 057 which has a much larger diameter than the mast foot pin, the width of the safety fastening means according to the invention does not surpass that of the mast foot pin so that the entire safety fastening means may be housed in a sliding shoe. This would not be possible with the known safety fastening means because the width thereof would require such a wide sliding shoe, and a corresponding wide opening in the slide track, that the surfer would run the risk of getting his toes caught in the slide track. It is by virtue of the particularly narrow design of the safety fastening means according to the invention that a correspondingly narrow slide track can be used which meets all safety requirements.

As the safety fastening means according to the invention takes up practically the whole room available inside the sliding shoe, this fastening means could not be used together with the known locking means provided in the sliding shoe because that would make the sliding shoe too long and the sliding path offered in the slide track would no longer be sufficient.

In accordance with another modification of the invention the bore is formed as a through bore, the stop being embodied by a pin extending parallel to the longitudinal axis and crossing the bore centrally. This pin in turn forms the pivot axis for the pawl adapted to engage in the notches of the locking member rod. At the same time the flexural stiffness of the sliding shoe, preferably made of plastics, is improved by this pin.

The catch may be embodied by a lock bolt which is movable radially with respect to the bore, the direction of movement being the same as the direction of the longitudinal axis of the sailboard. In accordance with another modification of the invention the catch is a pin arranged transversely of the longitudinal axis and being displaceable in the direction thereof and intersecting the bore in chord fashion. This pin needs the shortest possible structural length as seen in the direction of the longitudinal axis. Therefore, a short sliding shoe is feasible. At its end remote from the bore the pin is supported on the end of a screw provided with a head and disposed substantially parallel to the longitudinal axis. The head of this screw is positioned bow-ward and the screw passes with ample clearance through a closure plate disposed at the bow-ward end of the sliding shoe. On its shank, i.e. in the interior of the sliding shoe, the screw comprises a compression spring supported at one end by a nut arranged on the free end of the shank and, on the other hand, at the inside of the closure plate. The compression spring takes care that the face of the head of the screw facing the closure plate always lies in snug abutment against the closure plate so that the shank of the screw will extend perpendicularly with respect to the closure plate. If the shank should be deflected transversely of its longitudinal direction, it returns automatically into the starting position described, the magnitude of the return force depending on the tension of the compression spring, i.e. being dependent on how far the nut is screwed on the shank of the screw against the compression spring.

In accordance with another modification of the invention the nut is arranged to be fixed against rotation but displaceable axially with respect to the screw in a longitudinal guide means so that rotating the screw from outside is sufficient to augment or diminish the return force of the screw—depending on the sense in which the screw is rotated.

By its tip the scew is supported on the pin. If the pin is pressed in, it dislocates the tip of the screw against a previously adjusted return force.

In accordance with another modification of the invention a pointer or an indicator is connected with the nut which is fixed against rotation. The pointer is visible through a window formed in the upper side of the sliding shoe. Preferably marks are coordinated with the window so that the surfer, taking a glance at the sliding shoe, will know how great the adjusted overload is which is needed to release the safety fastening means.

When disassembling the sailboard, on principle, the safety fastening means may be released to unblock the mast foot by applying overload after the safety fastening means has been adjusted to a small release load. It is suggested in accordance with another modification of the invention that a trigger passing to the outside through the top of the sliding shoe be disposed above the shank of the screw with head to act on the screw so as to deflect the shank, thereby releasing the mast foot pin, an arrangement which makes the safety fastening means independent of the overload adjusted. It is preferred to have the screw with head and consequently also the trigger located at the bow side with respect to the bore receiving the mast foot pin. In this manner the trigger is located at a place which is outside of the range of action of the foot of a user during normal use of the sailboard, all the more so as there is no reason why a user should place his foot near the mast since the release button for the locking means serving to displace the sliding shoe is stationary at the sternward end of the slide track or in front of the centerboard receptacle.

The invention will be described further, by way of example, with reference to the accompanying drawings, in which:

In all figures identical reference numerals are used to identify corresponding members.

FIG. 1 shows a mast foot mounting system which may be installed as a complete set in the deck of a surfboard or sailboard.

Figures 1, 2, 3, 4, 5:
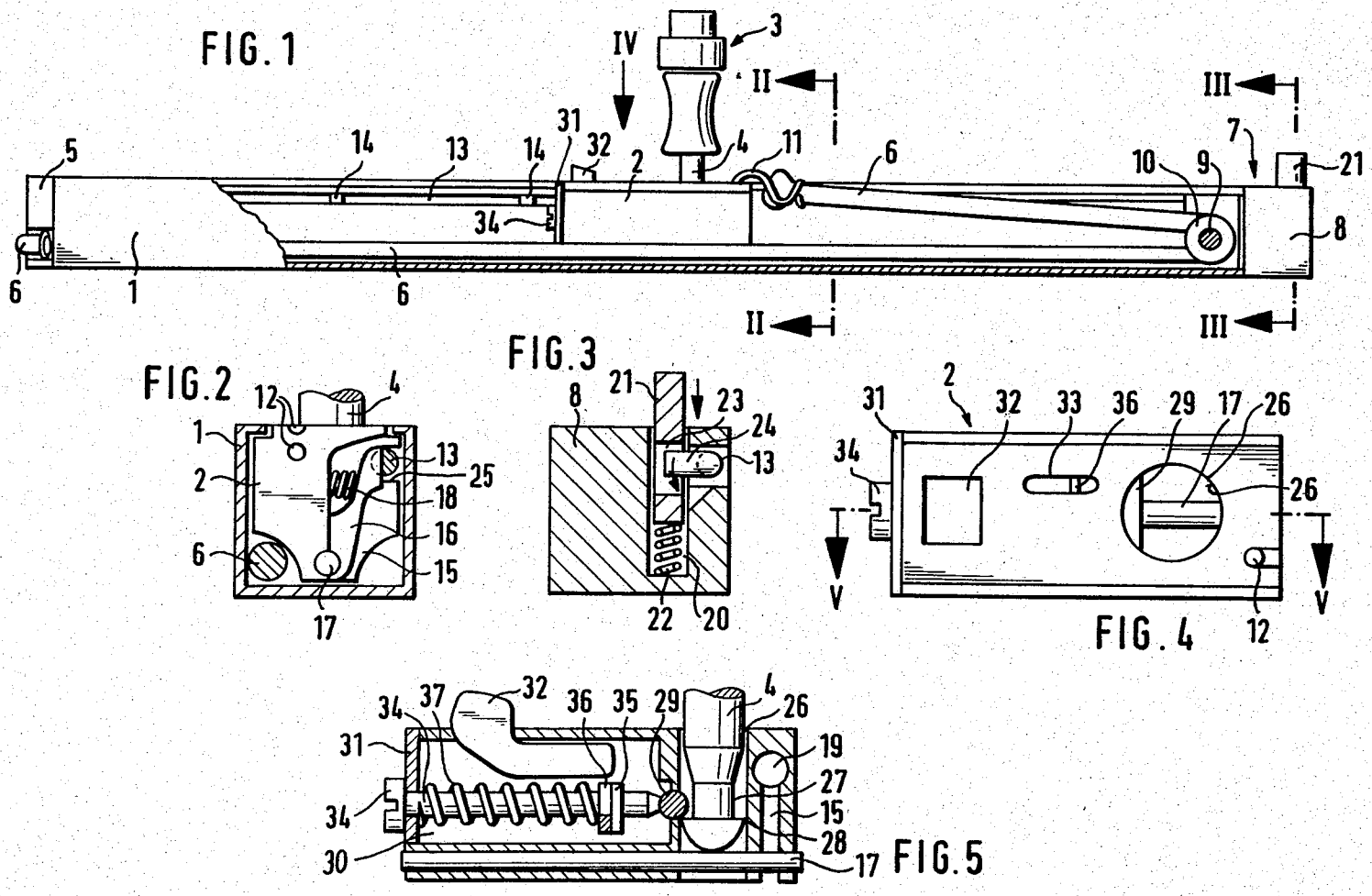
FIG. 1 is a side elevational view, partly in section, of a unit composed of a sliding shoe and a slide track and ready to be installed.
FIG. 2 is a sectional elevation on an enlarged scale along line II—II of FIG. 1.
FIG. 3 is a sectional elevation, on the same scale as FIG. 2, along line III—III of FIG. 1.
FIG. 4 is a top elevational view in the direction of IV in FIG. 1 and on the same scale as FIGS. 2 and 3, some parts having been left out for purposes of clarity.
FIG. 5 is a sectional elevation along line V—V of FIG. 4.

The mast foot mounting system consists of a slide track 1 having a U-shaped cross section, the free ends of the two lateral legs of which each are bent at an angle to face each other. The slide track 1 is made of extruded sectional aluminum material which may be surface treated, if desired, to improve its corrosion resistance.

A sliding shoe 2 is slid into the slide track 1 from one end thereof. Its outer configuration is designed to be complementary to the inner contour of the slide track 1 such that the sliding shoe is displaceable with only little clearance but without any effort inside the slide track and that its surface is flush with the outer upper edges of the slide track (see FIG. 2).

The sliding shoe is designed to be made of plastics and will be described in greater detail with reference to FIGS. 4 and 5.

The sliding shoe 2 carries a mast foot 3 ending in a mast foot pin 4 which in turn is secured in the sliding shoe 2.

The bow-ward or forward end (the left end in FIG. 1) of the slide track 1 is closed by a terminal block 5 made of plastics and being slid by one part into the open end of slide track 1. This part is enlarged in stepped fashion such that the outer faces of the section protruding out of the slide track 1 are flush with the outside faces of the slide track.

At its lower portside edge the terminal block 5 has a recess or longitudinal groove which is so dimensioned that it just permits passage of a rubber rope 6. This rubber rope 6 has a thickened portion outside of the slide track 1 formed by folding back and fixing of the free end of the rope.

The sternward end is closed by an actuating means 7 comprising a housing in the form of a unitary housing block 8 of plastics slid partly into the interior of the slide track 1 and having a portion which projects beyond the end of the slide track and is so dimensioned that its outer faces are flush with and merge into those of the slide track.

The housing block 8 is formed in its part located in the interior of the slide track and at the same side where the rubber rope 6 is located with a recess which is a little wider than the rubber rope 6. A rope pulley 10 is supported for rotation in this recess and the rubber rope 6 passes around and its guided by this pulley. The axis of rotation of the pulley 10 is embodied by a pin 9 which is fixed against rotation in the two lateral legs of the slide track 1 and in the housing block 8, thus guaranteeing the fixing thereof. The rope pulley 10 in turn is supported for rotation on the pin 9.

The free end of the rubber rope 6 is connected to a suspension hook 11 adapted to be engaged in a hang-up hole 12 (FIG. 2) formed in the sternward end of the sliding shoe 2. FIG. 1 clearly illustrates the course taken by the rubber rope 6, and it will be appreciated that the rubber rope 6, by virtue of its spring action, tends to pull the sliding shoe 2 toward the stern.

The terminal block 5 may be retained in the slide track 1 by fastening pins. Yet in principle, the spring tension exerted by the rubber rope 6 and tending to pull the terminal block 5 against the bow-ward end of the slide track 1 suffices to secure the terminal block 5 in place.

A locking member in the form of a rod 13 extending parallel to the slide track 1 and being supported for rotation in the terminal block 5 and in the housing block 8 is disposed in the upper starboard area of the slide track 1 near the starboard leg thereof. This locking member rod 13 is made of round material and notches 14 are milled into the same so as to face the sliding shoe 2, which notches are defined by side surfaces extending transversely of the slide track 1.

FIG. 2 is a section along line II—II of FIG. 1 showing the lower run of the rubber rope 6 in section, while the upper run and the suspension hook 11 are left out.

As may be taken from FIG. 2, the sliding shoe 2 includes a recess or longitudinal groove each adjacent the rubber rope 6 and the locking member rod 13, respectively, to permit free sliding movement of the sliding shoe 2 with respect to rubber rope 6 and rod 13 but, on the other hand, securing particularly the latter in such manner that no oscillation amplitude may build up in the area of the block which might impair the function of the mast foot mounting system.

The mast foot pin 4 is only shown broken away.

In its sternward end the sliding shoe 2 has a transverse cut-out 15 (FIG. 5) in which a locking pawl 16 is arranged for pivoting about a pin 17.

Pin 17 is fitted in the lower part of the sliding shoe 2 and extends parallel to the longitudinal direction thereof. As shown in FIG. 5, the pin 17 extends throughout the length of the sliding shoe 2, acting not only as the pivot axis of locking pawl 16 but also as reinforcement of the entire plastic sliding shoe 2 and further functioning as a stop for the lower end of the mast foot pin 4, as will be described in greater detail below.

The upper part of locking pawl 16 rests on a locking spring 18 which is guided in a spring bore 19 (FIG. 5).

As shown in FIG. 2, the locking spring 18 urges the locking pawl 16 toward locking member rod 13, the pawl 16 being of such configuration that it can snap into any one of the notches 14 and become fully seated on the bottom of the respective notch by its surface facing the locking member rod 13.

FIG. 2 shows the position of engagement of the locking pawl 16. If one imagines the locking member rod 13 in FIG. 2 rotated through at least 90°, it will be obvious that the notch 14 no longer faces the locking pawl 16 but instead is turned upwardly or downwardly. Then the locking pawl 16 is no longer seated on the bottom of the respective notch 14 but instead engages the outer periphery of the locking member rod 13. Under these circumstances it is easy to displace the sliding shoe 2 in longitudinal direction of the slide track 1. If the locking member rod 13 is returned to its position illustrated in FIG. 2, the sliding shoe 2 will continue to move until the locking pawl 16 snaps into the next notch 14 arriving, thereby preventing any further axial movement of the sliding shoe 2.

The mechanism by which the locking member rod 13 is rotatable through at least 90° is designed as an actuating means 7, housed in housing block 8, and shown in FIG. 3 which is a sectional elevation along line III—III of FIG. 1.

A vertical guide means 20 in the form of a blind hole of rectangular cross section is formed in housing block 8 for receiving the release element preferably in the form of a button or plunger 21 which has a corresponding cross section. The release button or plunger 21 is guided in this vertical guide means 20 so as to carry out rectilinear motions in the direction of the arrow shown but not to be rotatable.

A return spring 22 is disposed between the bottom of the blind bore and the underside of the release button or plunger 21. In its central area, yet offset toward the underside, the release button or plunger 21 has a recess 23 formed as a through hole of rectangular cross section.

The end of locking member rod 13 related to actuating means 7 is bent at an angle to form a crank 24 whose end engages in the recess 23 in such manner that the crank 24 carries out a pivoting movement in the direction of the arrow shown by about 90° when the release button is actuated.

Guidance of the locking member rod 13 is taken care of by a groove 25 formed in the housing block 8 (FIG. 2) in longitudinal direction of the slide track 1 and accommodating the rod 13 for rotation. The housing block 8 is recessed within the path of movement of the crank 24 so that the undisturbed sequence of movements described is warranted.

During assembly, first, the return spring 22 is to be inserted in housing block 8, then the release button or plunger 21 is to be placed on top and pressed down, and thereafter the locking member rod 13 with its crank 24 may be introduced laterally from outside into the groove 25 or recess 23.

Subsequently, the housing block 8 is pushed into the sternward end of the slide track 1, rope pulley 9 is inserted, and the pin 9 is driven in so as to fasten all members at the slide track 1.

FIGS. 4 and 5 show the sliding shoe and in particulary the safety fastening means for mast foot pin 4. For the sake of clarity of the illustration, the slide track, rubber spring, and locking member rod are left out.

In FIG. 4 also the mast foot pin is left out.

In FIG. 5 the locking pawl 16 and the locking spring 18 are not shown. At its top the sliding shoe 2 includes a mast foot bore 26 into which the mast foot pin 4 may be inserted with but little clearance.

This mast foot pin 4 has an annular recess 27 near its free end limited toward the end by a shoulder which projects in radial direction and defines a collar 28. The side of the collar 28 facing the free end of the mast foot pin 4 is chamfered or rounded.

The pin 17 already described above penetrates bore 26 diametrically and in longitudinal direction of the sliding shoe 2, forming a stop for the downward movement of the mast foot 4 into the bore 26.

A blocking rod 29 extending chordwise into the bore 26 at the bow-ward side thereof is disposed transversely of pin 17.

The blocking rod 29 engages behind the ring collar 28 of the mast foot pin 4. It is essential that the blocking rod 29 project into the bore 26 by a lesser extent than the dimension of the radius of the blocking rod 29.

The blocking rod 29 preferably is embodied by a ground steel pin.

As shown in FIG. 5, a cavity 30 is formed toward the bow with respect to bore 26 and closed by a closure plate 31 at the face end of the sliding shoe 2.

The upper wall defining the cavity 30 has a central aperture for passage of a trigger 32 and an oblong hole 33 which extends parallel to the longitudinal axis of sliding shoe 2 but offset laterally with respect to the same.

Approximately at the level of blocking rod 29 the closure plate 31 includes a hole through which passes with ample clearance the shank of a screw 34 with a head.

In contiguous relation to the shank the head of screw 34 constitutes a radial shoulder by which the head is adapted to lie flatly against the closure plate 31.

A square nut 35 is screwed on the end of screw 34 with head so as to be displaceable axially with respect to the shank in a longitudinal guide means (not shown in the drawing) but, at the same time, being prevented from rotating.

An indicator element 36 is firmly connected to nut 35 and its tip is visible from outside of the sliding shoe 2 through the oblong hole 33.

When rotating the screw 34 in one or the other direction, the square nut 35 and thus also the indicator element 36 are caused to carry out translatory movement in one or the other direction.

A compression spring 37 is arranged to surround the shank of screw 34 between the indicator element 36 and the inside surface of closure plate 31. The free end of the shank of screw 34 is tapered or rounded and rests against the blocking rod 29, the central axis of screw 34 preferably being located somewhat below the central axis of the blocking rod 29.

The mode of operation of the safety fastening means shown for the mast foot pin is as follows: When the mast foot pin 4 is pulled upwardly with a certain force, the collar 28 presses the blocking rod 29 in upward direction and outwardly with respect to the bore 26. If a certain force is surpassed in pulling out the mast foot pin 4, the force acting on the tip of the screw 34 deflects the latter to the left as shown against the pressure of spring 37 so that the blocking rod 29 is able to give way radially outwardly and upwardly with respect to bore 26.

In this context the force to be applied in order to pull out the mast foot pin 4 is directly dependent on the pressure of compression spring 37 and thus on the position of square nut 35 which more or less compresses the spring 37. If the release force is to be reduced, the screw 34 must be turned in counterclockwise sense which will cause the nut 35 to travel toward the tip of the shank (provided the thread is right-handed). Upon rotation in opposite sense, the nut 35 will travel in opposite direction to compress spring 37 more strongly. The respective position of the nut 35 and consequently the release force adjusted may be read directly from the tip of the.indicator element 36 visible in the oblong hole 33, the margin of which preferably may be provided with a scale.

The trigger 32 which protrudes beyond the outer sides of sliding shoe 2 and continues inwardly into the cavity 30 in the direction of bore 26 is disposed between the screw and the upper wall defining the cavity 30. As pressure is exerted on the trigger 32, the trigger will press on spring 37 and thereby on the shank of screw 34 in radial direction of the latter, whereby the spring is deflected. Then evasion is easy for the blocking rod 29 if the mast foot pin 4 is to be pulled out. When using a mast foot mounting system as shown, it will be let in flush with the deck of a sailboard, as illustrated in FIG. 1. The surfer's foot will be next to or behind the actuating means 7 so that the release button 21 will be operable by the toes.

Upon actuation of the release button 21, the mast foot 3 will be subjected to a force which presses it toward the bow and results from the wind pressure acting on the sail, whereas the force of the rubber rope 6 will be effective in opposite direction. Therefore, fundamentally the sliding shoe 2 will be balanced. Yet as the magnitude of the wind pressure acting on the sail varies, a more or less strong supportive or counterforce depending on the wind conditions will have to be exerted on the mast by the wishbone boom (not shown) in order to displace the sliding shoe in one or the other direction.

If the position of the sliding shoe 2 is to be changed, the release button 21 is actuated, which will turn the locking member rod 13 by way of crank 24 so that the rod will be pivoted to free one of its notches 14 from the engagement with locking pawl 16. Thereupon the sliding shoe 2 may be displaced until the release button 21 is let go again. The sliding shoe 2 then will move in the selected direction until the pawl 16 snaps into the next notch 14. This will fix the sliding shoe in position.

The function of the safety fastening means housed in the sliding shoe 2 has been described already. It should be noted that the trigger 32 is located at the side of the mast remote from the surfer so that there is no risk that the surfer accidentally might touch the trigger 32.

What is claimed is:

1. In a mast foot mounting system for a sailboard, including a sliding shoe provided with a receptacle for removably connecting a mast foot pin, said shoe being displaceably mounted in a guideway adapted to be mounted in the longitudinal direction of the sailboard; a locking means for fixing the sliding shoe in at least two longitudinal positions along the guideway; and a foot-operated release element for releasing the locking means; the improvement comprising said release element being disposed in a fixed position relative to the guideway.

2. The improvement in a mast foot mounting system as recited in claim 1, wherein the release element is located at the sternward end of the guideway, and said guideway is configured as a slide track.

3. The improvement in a mast foot mounting system as recited in claim 2, wherein the locking means comprises an elongated movable locking member disposed within the guideway parallel to the longitudinal direction, said locking means having locking formations each associated with one of the positions of the sliding shoe; a counter-locking assembly disposed in the sliding shoe and engageable with a respective one of the locking formations at the predetermined positions of the sliding shoe; and an actuator means disposed at a fixed location at the sternward end of the guideway and carrying the release element; said actuator means comprising a coupling which is connected to the release element and to the locking member in such a manner that actuation of the release element causes the locking member to be moved in a direction such that its locking formations become disengaged from the counter-locking assembly.

4. The improvement in a mast foot mounting system as recited in claim 3, wherein the locking member comprises a movable rod having longitudinally spaced notches along one longitudinal side thereof which constitutes said locking formations.

5. The improvement in a mast foot mounting system as recited in claim 4, wherein the counter-locking assembly comprises a pawl supported in the sliding shoe for pivoting movement around an axis parallel to the longitudinal axis of the guideway and adapted to enter into arresting engagement in any one of said notches, and wherein said coupling of said actuator means comprises a rotary drive means for movement of the locking member rod about its longitudinal axis by such an angle of rotation that the notches are rotated out of the range of engagement of the pawl or that a formation provided on the locking member rod drives the pawl out of engagement with the notches.

6. The improvement in a mast foot mounting system as recited in claim 4, wherein the locking member rod is disposed next to an inside wall of the guideway with said notches turned away from said inside wall; the side face of the sliding shoe facing toward said inside wall including a longitudinal groove through which the locking member rod extends, said groove and inside wall restraining free lateral movement of said locking member rod.

7. The improvement in a mast foot mounting system as recited in claim 5, wherein one end of the locking member rod extends into the actuator means and is bent at an angle to constitute a drive crank; said release element comprises a vertically movable plunger; a vertical guide means in the actuator means; said plunger disposed in said vertical guide means for vertical movement therein; said plunger including a recess in its central area; the bent end of the crank extending into the recess for selective vertical engagement by the plunger to rotate the locking member rod.

8. The improvement in a mast foot mounting system as recited in claim 7, wherein said slide track is open at its sternward end; said actuator means comprising a housing block inserted into said sternward end of the slide track; said housing including said vertical guide means serving to guide said release element in a vertical direction; spring means engageable with the release element for biasing the release element in an upward direction within the vertical guide means; and a groove into which the end of the locking member rod extends.

9. The inprovement in a mast foot mounting system as recited in claim 2, including a spring means for biasing the sliding shoe in a sternward direction, the spring means extending between the slide track and the sliding shoe.

10. The improvement in a mast foot mounting system as recited in claim 9, wherein the spring means is a rubber strand attached to and extending between one end of the slide track and the sliding shoe.

11. The improvement in a mast foot mounting system as recited in claim 10, wherein the slide track is open ended at its forward end and including a fixed terminal block inserted into said forward open end, said rubber strand attached at one end to said terminal block, then extending sternward between a longitudinal groove formed in the sliding shoe and the adjacent inside wall of the slide track, and then over a guide pulley mounted at the sternward actuator means, and thence forward to the sternward end of the sliding shoe.

12. The improvement in a mast foot mounting system as recited in claim 11, said locking means comprising a longitudinally extending movable locking member rod extending along one side of the slide track, said sliding shoe including a groove through which said locking member rod extends, said longitudinal groove arranged to receive said rubber strand; said longitudinal groove being located approximately diagonally opposite said groove for receiving the locking member rod with respect to the longitudinal axis of the guideway.

13. The improvement in a mast foot mounting system as recited in claim 1, including releasable fastening means for the mast foot pin in the sliding shoe, said releasable fastening means comprising means for releasing the mast foot pin when the latter is subjected to predetermined overload forces tending to withdraw the mast foot pin from the receptacle in the sliding shoe.

* * * * *